US005095544A

United States Patent [19]

Elverskog

[11] Patent Number: 5,095,544

[45] Date of Patent: Mar. 17, 1992

[54] PROTECTIVE CHAPS

[76] Inventor: Gerth Elverskog, 53 Hemmelskamp Rd., Wilton, Conn. 06897

[21] Appl. No.: 502,928

[22] Filed: Apr. 2, 1990

[51] Int. Cl.[5] ..... A41D 17/02

[52] U.S. Cl. ..... 2/22; 2/2.5; 2/51; 2/79; 2/227

[58] Field of Search ..... 2/2, 25, 22, 23, 24, 2/51, 75, 79, 80, 227

[56] References Cited

U.S. PATENT DOCUMENTS

| | | | |
|---|---|---|---|
| 849,268 | 4/1907 | Rutenbeck | 2/51 |
| 945,345 | 1/1910 | Richards | 2/51 |
| 952,179 | 3/1910 | Beckmann | 2/51 |
| 981,024 | 1/1911 | Stall | 2/23 |
| 1,031,054 | 7/1912 | Daum | 2/51 |
| 1,062,697 | 5/1913 | Daum | 2/51 |
| 1,217,855 | 2/1917 | Zimmermann | 2/52 |
| 1,628,433 | 5/1927 | Schilke | 2/52 |
| 1,646,524 | 10/1927 | Blakey | 2/51 |
| 1,801,437 | 4/1931 | Lown et al. | 2/22 |
| 3,269,036 | 8/1966 | Parker et al. | 2/22 X |
| 4,280,342 | 7/1981 | Eng et al. | 2/22 X |
| 4,351,065 | 7/1982 | Bouchard | 2/23 |
| 4,370,757 | 2/1983 | Richmond | 2/114 X |
| 4,382,301 | 5/1983 | Hightower, Jr. | 2/2.5 X |
| 4,453,271 | 6/1984 | Donzis | 2/2.5 X |
| 4,922,551 | 5/1990 | Anthes | 2/79 |

FOREIGN PATENT DOCUMENTS

| | | | |
|---|---|---|---|
| 2199233 | 7/1988 | United Kingdom | 2/2 |

*Primary Examiner*—Werner H. Schroeder
*Assistant Examiner*—Jeanette E. Chapman
*Attorney, Agent, or Firm*—Edward R. Hyde

[57] ABSTRACT

The invention is a design of protective chaps to be worn over trousers to protect the user of a chain saw. The chaps are asymmetrical and angled to cover the left side of the user's right leg which is especially susceptible to injury.

6 Claims, 2 Drawing Sheets

PROTECTIVE CHAPS

BACKGROUND OF THE INVENTION

1. Field of the Invention

The present invention relates to chaps that are worn over trousers. The chaps of the invention are of the type that provide protection to the wearer who may be using a chain saw. It sometimes occurs that the chain saw will be misused or otherwise become out of control and cut the leg of the user. To minimize injuries in such cases, protective garments such as chaps are worn by the sawer.

The present invention pertains to a unique design and construction of chaps to give greater protection to the wearer from injuries due to the misuse of the chain saw.

2. Description of the prior art

Chaps and other protective clothing have been used in the past to cover the legs of the user of a chain saw. Representative of prior art chaps are shown in U.S. Pat. No. 4,279,956 to Bartels, U.S. Pat. No. 4,280,342 to Eng et al. and U.S. Pat. No. 4,351,065 to Bouchard. These patents are directed to various designs of garments or padding for garments that are designed to protect the user of a chain saw.

Chainsaw operators working in forests and farms and the week-end home logger are regularly involved in the removal of branches from trees which is a particularly dangerous operation in that the chain saw can become out of control and injure the user. Saws are often operated in short downward movement strokes to cut branches and the user will apply a downward force against the branch to enhance the sawing operation. When the saw cuts through the branch it has nothing to stop its downward movement and can well hit the user in the upper or lower leg area causing serious injury. Accordingly, the prior art garments such as leggings and chaps have been provided with pads in which the material in the padding will jam and stop the saw operation if the saw comes in contact with the padding. The chaps of the prior art fail to provide certain leg protection that the present invention is designed to protect.

SUMMARY OF THE INVENTION

Conventional padded chaps to protect the users from the high speed saw chain are of a symmetrical design in which the leg of each chap fits over the corresponding trouser leg of the sawer. The chap legs are symmetrical in that each one covers its corresponding trouser leg in the same area which may generally be described as the forward or front portion of each trouser leg.

Chain saws have been designed to be operated by right handed people and in operation are held so that the saw bar and blade extends somewhat to the left of the sawer. Thus a downward movement of the saw chain that is extending leftward is more likely to engage and injure the left portion of the sawer's right leg. With conventional chaps the right chap does not adequately protect the left side of the user's right leg. Thus a downward movement of the saw after it has, for example, cut through a tree branch will come into contact with the left side of the user's leg without fully contacting the covering chap. Because the saws are used in a right handed manner, extending to the left of the sawer, the vast majority of injuries are on the left side of each leg. It is to this general problem that the present invention is directed.

Accordingly it is an object of the present invention to provide a pair of protective chaps that more fully protect the user's legs than the chaps heretofore designed.

Another object of the present invention is to provide protective chaps in which the chaps fully protect the left sides of the user's legs where most injuries occur.

A further object of the present invention is to provide protective chaps used by chain saws in which the right leg chap is designed to fully protect the left side of the right leg.

A still further object is to provide protective chaps of an asymmetrical design that more fully protect the sawer's legs.

BRIEF DESCRIPTION OF THE DRAWINGS

The foregoing and still other objects and advantages of the present invention will be more apparent from the following detailed explanation of the preferred embodiments of the invention in connection with the accompanying drawings herein in which.

DESCRIPTION OF THE PREFERRED EMBODIMENT

Figure 1:
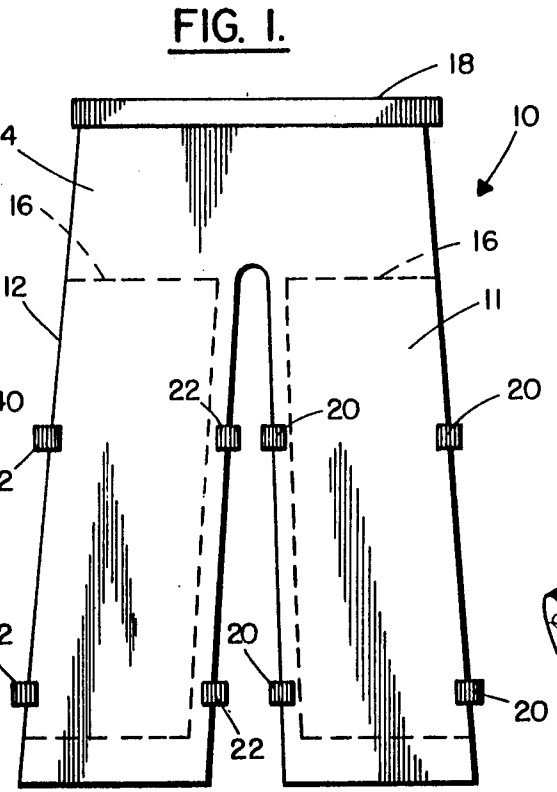
FIG. 1 is a front view of protective chaps of the type known to the prior art.

Referring now to the drawings and more particularly to FIG. 1, there is shown a front view of chaps 10 of the type formerly used in the prior art. The chaps include a left leg 11, right leg 12 and waist portion 14 that are all integral and may be made of nylon or other suitable durable material. Each of the legs will include padding indicated by dotted lines 16 that is intended to protect the chain saw user. The chaps are completed by a waist belt 18 and leg straps 20 and 22.

Figure 2:
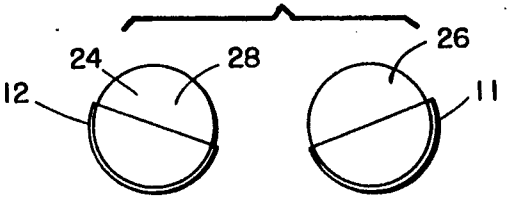
FIG. 2 is a diagramatic representation of a cross section of the upper portion of the user's legs wearing the chaps of the prior art of FIG. 1.

In use, the wearer will secure the belt 18 about his waist and each of the leg portions 11 and 12 will cover the generally forward portions of the user's legs and be held in place by the leg straps 20 and 22 which may be buckled about the rear of the user's legs. With these chaps of the prior art in place, they cover the user's legs in a manner shown in FIG. 2 where 24 and 26 represent the thigh or upper portions 24 and 26 of the user's right and left leg respectively. It is seen that the chap legs 11 and 12 cover the front and outer portions of the legs. Of particular concern is the fact that the inner portion of the right leg 28 is uncovered by the right chap leg 12. It is to this general problem that the chap design of the present invention is directed.

Figure 3:
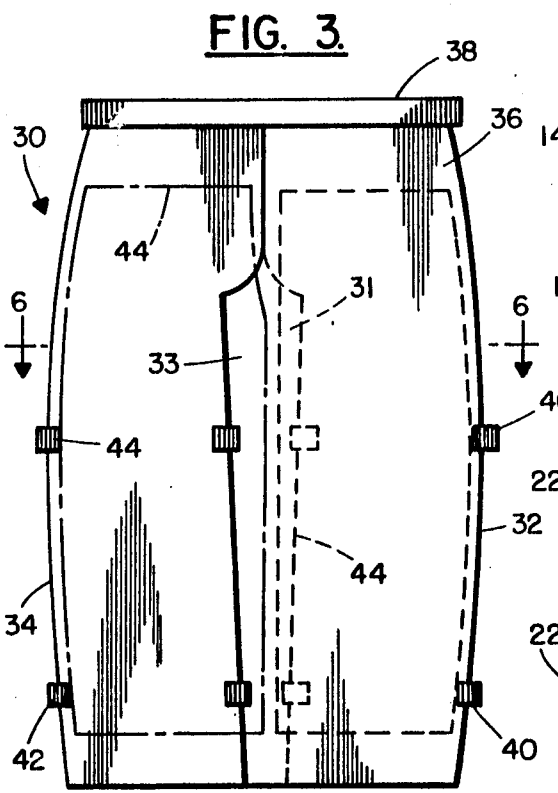
FIG. 3 is a front view of the protective chaps of the present invention.

Referring now to FIG. 3, there is shown the chaps design of the present invention with the chaps generally indicated by numeral 30. The chaps include left and right leg portions 32, 34 and a waist 36 having a waist belt 38. The chaps include this outer shell which may be made of a material such as nylon that provides flexibility and comfort to the wearer. A sheet of padding material indicated by the dotted lines 44 is sewed to the underside of each of the chap legs 32, 34.

The chap legs 32, 34 are generally rectangular when spread flat as in FIG. 3. Each leg has an elongated flap portion 31, 33 extending from the lower end to the waist portion 36. These flaps overlap when the chaps are spread out as shown.

The padding may take various forms and one particularly effective type is a fiberous padding known as Prolar and sold by the Elvex Corporation of Bethel, Conn. Another example of a type of padding made for the purpose of jamming a chain saw is described in U.S. Pat. No. 4,280,342. When a chain saw comes in contact with the padding, the fibers will be drawn into the chain saw sprocket to jam and stop the operation of the saw thereby preventing or minimizing injury to the user.

Figure 4:
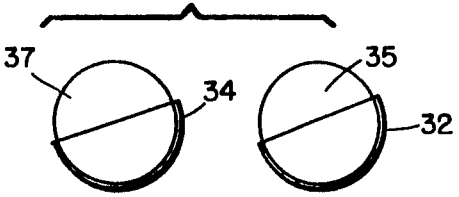
FIG. 4 is a diagramatic representation of a cross section of the upper portion of the user's legs wearing the chaps of the present invention of FIG. 3.

A particularly novel feature of the present design is that of the asymmetrical arrangement of the chap legs worn by the chain saw user as more clearly shown in FIG. 4. It is therein seen that the left leg 35 is covered in the front and the chap is angled around toward the outside of the leg in the normal manner. The right chap leg 34, on the other hand, in addition to covering the front portion, of the leg 37 is angled around toward the inside of the user's right leg. Thus the chap legs are both angled around to cover the left portions of both legs to protect them from the out-of-control chain saw that is normally held toward the left side of the user. The chaps of the present invention when worn by the sawer may be described as being asymmetrical in that the left leg is angled outside to protect the left side of the leg whereas the right leg chap is angled inside to protect the left side of the right leg.

Figure 5:
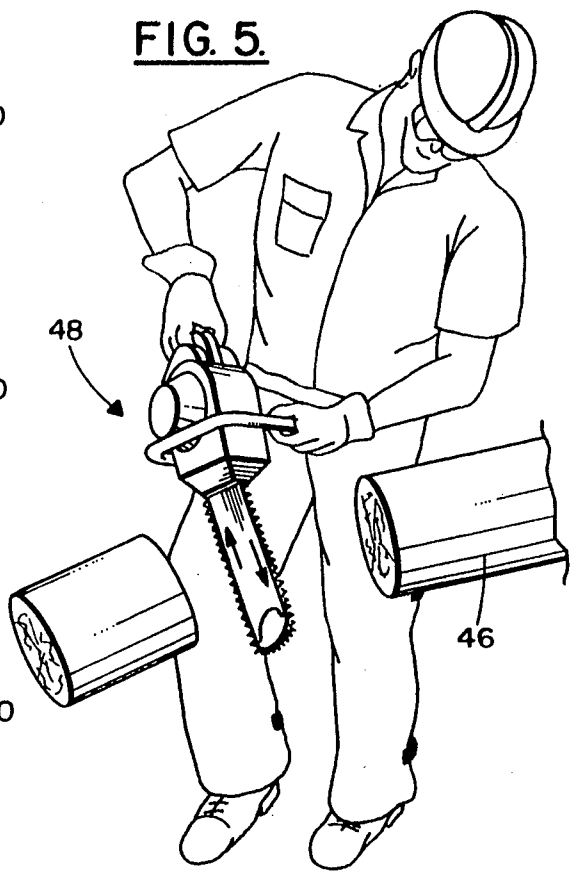
FIG. 5 shows a user of a chain saw that has just cut through a branch and because of the downward pressure of the saw has come in contact with the left side of the user's right leg.
Figure 6:
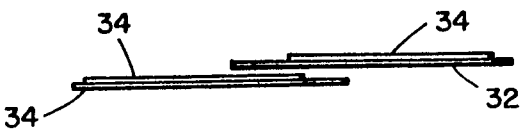
FIG. 6 is a sectional view taken on the line 6—6 of FIG. 3.

FIG. 5 shows a saw which has just sawed through the log or branch 46 and in which the chain of the saw 48 has come down in contact with the inside of the sawer's right leg. With the chaps of the present invention the right leg chap 34 will cover this inside portion of his right leg and the padding material will inhibit the saw from injuring the leg.

It is also seen from FIG. 5 that with the saw chain moving in a clockwise direction as shown by the arrows, it will tend to move the right chap to the sawer's outside. With the prior art chap of FIG. 2, the right chap would move to uncover the leg. With the chap of the present invention in which the right chap is angled to the sawer's inside, it well protects the leg even if it is caused to rotate somewhat by the moving chain saw.

Figure 7:
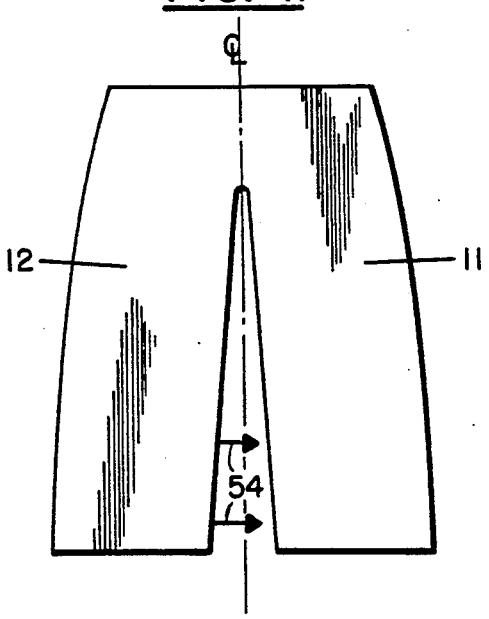
FIGS. 7 and 8 illustrate the manner in which the asymmetrical pattern of the present invention is developed.
Figure 8:
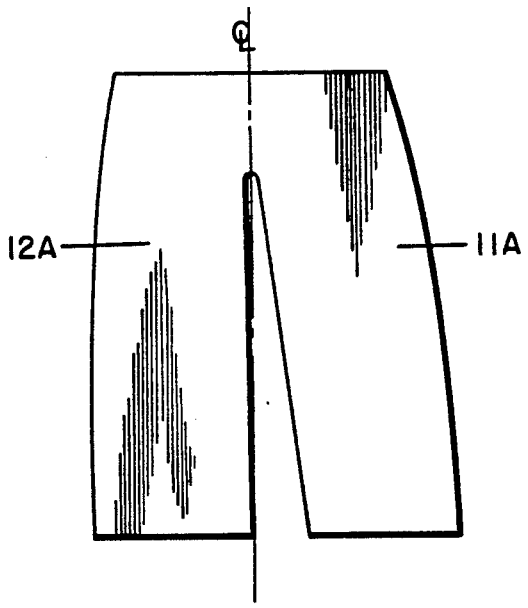

Referring now to FIGS. 7 and 8 there is illustrated the manner in which the pattern is constructed for the asymetrical chap design. In FIG. 7 numerals 11 and 12 indicate the left and right chap leg patterns respectively of the prior art symetrical design. It is seen that these prior art chaps are symmetrical with respect to the centerline passing therethrough. It is understood that it is the right leg pattern that is modified to provide the protection for the inside of the sawers right leg as shown in FIG. 4 and 5. This modified right leg pattern is shown as 12A in FIG. 8. It differs from 12 in that it is closer to and angled toward the left leg as shown by arrows 54.

In FIG. 8 the two patterns (or two shells) 11A and 12A of the chaps are shown in the asymmetrical construction with respect to the chaps centerline.

In summary, the present invention is designed to protect the inner side of the sawer's right leg. It accomplishes this by designing the right chap to be angled to the left which results in an asymmetrical pattern with respect to the chap's centerline. This asymmetrical pattern is clearly shown in FIGS. 4 and 8. As a result of this pattern design, the left side (or inside) of the right leg is protected as clearly shown by 34 in FIG. 4. The left leg chap is not modified from the chaps of the prior art because it adequately covers the left leg of the sawer. It is the modified right leg that results in the asymmetrical design.

Having thus described the invention with particular reference to the preferred forms thereof, it will be obvious that various changes and modifications may be made therein without departing from the spirit and scope of the invention as defined in the appended claims.

What is claimed is:

1. Chaps for protecting legs of a user of a chain saw comprising:

first and second leg portions adapted to fit over a trousers of a user;

each leg portion having an upper end and a knee area;

a waist portion;

the upper end of each leg portion secured to the waist portion;

the width of each leg portion at the knee areas thereof being adapted to partially encircle a user's leg;

the upper ends of the two leg portions being joined;

one of said leg portions being angled with respect to and in the direction of a center line perpendicular to the waist portion passing through the junction of the leg portions whereby the angled portion extends inwardly to encircle the inward side of the user's corresponding leg to provide chaps that are asymmetrical to the centerline.

2. The garment as set forth in claim 1 in which each chap leg includes a protective pad of a fibrous material adapted to jam the mechanism of a chain saw upon the saw blade cutting through the pad.

3. The garment as set forth in claim 2 in which each chap leg includes belt and buckle means to secure the chap leg to the leg of a chain saw user.

4. A garment for protecting the legs of the user of a chain saw comprising:

a shell of fabric material;

said shell including a waist, a right leg and a left leg all integral as portions of the said shell;

said right leg and left leg each being of generally rectangular shape to extend from a user's ankles to the top part of his legs;

each leg having an elongated flap portion extending the length thereof of the inside side of the leg;

said flaps being overlapping when the garment is in a flat position;

a protective pad secured to the underside of each leg;

each pad including a knit-weave of fibers adapted to entangle in the sprocket of a chain saw upon the saw chain cutting through the pad;

each leg having a pair of leg straps to secure the leg to a sawer's leg;

a waist belt to be secured to the upper edge of the waist; and said chaps being asymmetrical whereby said right leg is angled toward said left leg to provide coverage of the inner side of a user's right leg.

5. Chaps for protecting legs of a chain saw user comprising:

right and left elongated chaps legs each having an upper end and a knee area;

a waist;

the upper end of said right and left chaps leg secured to the said waist;

the width of each leg at the knee area being adapted to partially encircle a user's leg;

the upper end of each chaps leg being joined together to define a centerline of the chaps extending perpendicular to the waist and extending through the junction of the upper ends of the two chaps legs;

said right leg being angled in a direction toward said centerline to provide coverage of the inner side of a user's right leg whereby the chaps are asymmetrical with respect to the said centerline.

6. The chaps as set forth in claim 5 in which the left leg is angled in the direction away from said centerline.

* * * * *